US005253231A

United States Patent [19]

Vuilleumier

[11] Patent Number: 5,253,231

[45] Date of Patent: Oct. 12, 1993

[54] BRAKING ARRANGEMENT FOR A GEAR WHEEL

[75] Inventor: Cyril Vuilleumier, Bienne, Switzerland

[73] Assignee: Eta SA Fabriques d'Ebauches, Granges, Switzerland

[21] Appl. No.: 775,269

[22] Filed: Oct. 11, 1991

[30] Foreign Application Priority Data

Oct. 22, 1990 [CH] Switzerland ..... 03363/90

[51] Int. Cl.[5] ..... G04B 29/00

[52] U.S. Cl. ..... 368/322; 368/323; 368/184; 368/220; 368/223

[58] Field of Search ..... 368/76, 80, 74, 185-190, 368/203-204, 319-326

[56] References Cited

U.S. PATENT DOCUMENTS 3,610,753 10/1971 Neubauer ..... 368/220
3,695,033 10/1972 Fujimori ..... 368/220
4,684,263 8/1987 Etienne ..... 368/220
4,794,576 12/1988 Schwartz et al. ..... 368/185

FOREIGN PATENT DOCUMENTS 8436089 3/1985 Fed. Rep. of Germany .
1344794 10/1963 France .
2030436 11/1970 France .

*Primary Examiner*—Bernard Roskoski
*Attorney, Agent, or Firm*—Weil, Gotshal & Manges

[57] ABSTRACT

This invention concerns a braking arrangement for a gear wheel. The purpose of the invention is to brake the last wheel in a gear train in order to avoid the latter rotating through unequal angular steps. Such purpose is achieved with the help of an element forming a brake (1) fixed onto a first wheel set (2) of a gear train in a manner to be driven in rotation by the latter, such element (1) exhibiting a friction surface (39) at its periphery brought to bear elastically onto a second wheel set (6) meshing with the first so as to brake such second wheel set (6). The invention is more especially applied to horological and chronograph gearing.

15 Claims, 5 Drawing Sheets

BRAKING ARRANGEMENT FOR A GEAR WHEEL

This invention concerns a braking arrangement for a gear wheel.

BACKGROUND OF THE INVENTION

It is known that in gearing it is desirable to provide for a certain number of clearances and in particular backlashes or play between the teeth of driving and driven wheels respectively. These clearances are necessary on the one hand because of the manufacturing tolerances and on the other hand because they avoid jamming of the two wheels during their rotation. At the same time, because of such backlashes, the driven wheel sometimes rotates jerkily. This is still further accentuated when it concerns the last wheel in a gear train including several.

In horology this problem is crucial to the extent that the user of a watch may note that one of the hands advances by jumps. Such may be the case for instance for the seconds hand when the latter is secured onto the last wheel of a gear train. If it concerns a watch without complications, the user has the impression that the seconds wheel rotates in an irregular fashion and, if it concerns a chronograph watch, that the displayed time lacks precision.

In order to overcome these difficulties, there has already been proposed, as described in Swiss patent CH 506 824, an arrangement providing friction on a rotating element in a chronograph movement. More precisely, there is arranged a spring under a chronograph wheel which is borne by a shaft to which it is fixed. This spring comprises an annular portion which is coaxial to such shaft as well as two diametrally opposed arms fastened at their free ends onto a bridge. It thus exerts an axial force on the chronograph wheel in order to prevent knocking of the chronograph hand.

However, this type of friction arrangement can only be employed if the wheel requiring braking is located directly above the bridge and on condition that one has available sufficient space between such wheel and the bridge in order to place such arrangement. Sometimes the wheel which one wishes to brake is itself placed above one or several other gear wheels. It is then impossible to employ the arrangement previously suggested.

There are also known braking arrangements employing magnetism. In this case a magnet, generally of platinum-cobalt, is secured for instance in the bridge placed above the wheel to be braked. Under the action of such magnet, the wheel is drawn towards the bridge and its axis rubs on the bearing situated in the bridge, the effect of which is to brake the wheel.

At the same time, platinum-cobalt magnets are expensive and this technique requires the employment of gear trains formed in a material having magnetic permeability.

As a consequence, the invention has as purpose to overcome the difficulties previously cited from the prior art by providing a braking arrangement for a gear wheel which is inexpensive and capable of being adapted to any type of gearing whatsoever.

SUMMARY OF THE INVENTION

To this end, the invention has as its object a braking arrangement for a gear wheel intended to be employed in a gear train comprising at least two wheel sets, a first wheel set comprising a toothed wheel pivoting around a shaft and meshing with a second wheel set comprising a second toothed wheel pivoting around a second shaft parallel to said first shaft. Such braking arrangement comprises an elastic element forming a brake which is arranged coaxially to the first wheel set.

According to the characteristics of the invention, initially, the element forming the brake is associated with the first wheel set in a manner to be driven in rotation by the latter, secondly, such brake forming element exhibits a friction surface at its periphery and thirdly the axial position of such brake forming element relative to the first axis is chosen relative to the axial position of the second wheel in a manner such that, in the meshing zone of the wheel sets, the corresponding portion of said friction surface bears elastically against one of the faces of said second wheel so as to brake the latter.

Thanks to these characteristics of the invention, one may arrange the brake forming element directly onto the first wheel set and secure such element upon the latter. It is no longer necessary to provide fastening onto the bridge.

According to the invention, the brake forming element has, in its released state, the form of a washer arched along one of its diametral axes the cavity of which is directed towards the first toothed wheel on which it is secured.

Thus, such washer forms a spring and permits increasing the friction force exerted by the friction surface onto the second wheel, which is to be braked.

Finally, it will be noted that the brake forming element is preferably formed of brass. Thus, one obtains a braking element which is inexpensive to manufacture.

The invention will be better understood upon reading the description to follow, given by way of illustrative non-limiting example, such description having been made in connection with the attached drawings.

DESCRIPTION OF THE PREFERRED EMBODIMENTS

Figure 1:
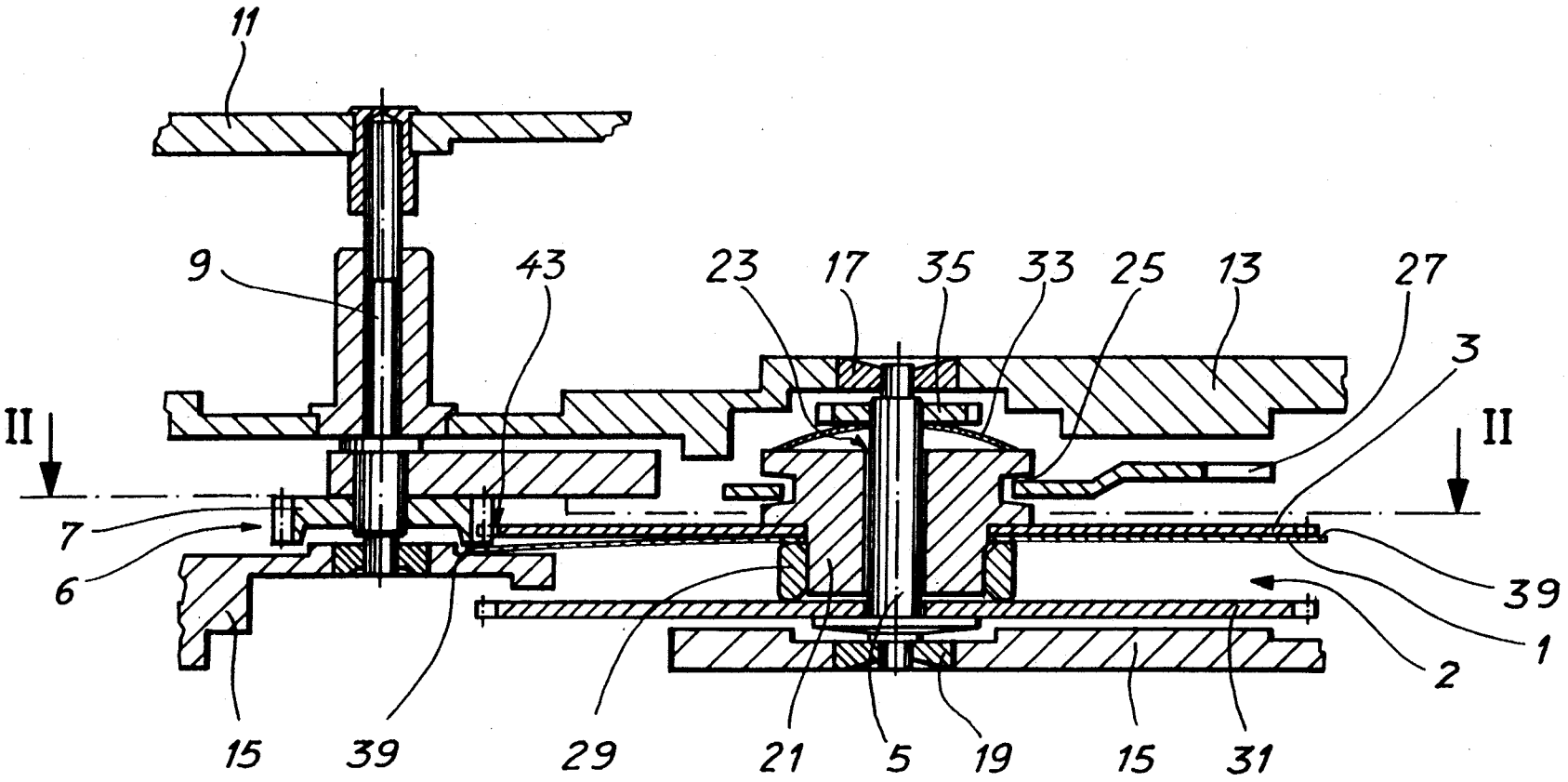
FIG. 1 shows a cross-section of the braking arrangement according to the invention assembled on one of the wheels of a gear train in a chronograph.

As shown on FIG. 1, the braking arrangement 1 in accordance with the invention is used in a gear train intended in particular to equip a timepiece such as a chronograph. Such gear train comprises at least two wheel sets, namely a first wheel set 2 comprising a toothed wheel 3 pivoting around a shaft 5 and meshing with a second wheel set 6 comprising a toothed wheel 7, itself pivoting around a shaft 9 parallel to the first shaft 5. Preferably, the braking arrangement 1 is associated with the first wheel 3 which here is a driving wheel and it enables braking the second wheel 7 which is driven. Nevertheless, one could also associate the braking arrangement with the driven wheel so as to act on the driving wheel, as long as the driven wheel has a diameter sufficiently great and the driving wheel is sufficiently thick to avoid deformation thereof under the action of the brake forming element. In the case of a chronograph shown by way of example in FIG. 1, the second wheel 7 is a chronograph wheel and shaft 9 bears the chronograph hand 11 while the first wheel 3 is a clutch wheel. The two wheels 3 and 7 are arranged in a standard manner between a bridge 13 and a base plate 15. Shaft 5 is maintained between an upper bearing 17 mounted in bridge 13 and a lower bearing 19 mounted in base plate 15. The clutch wheel 3 is placed around a clutch hub 21 provided with an axial bore 23 provided for passage of the first shaft 5. Such clutch hub could also be the hub of the wheel in the case of a simple gear wheel.

As described in greater detail, for instance in Swiss patent CH 661 404, such clutch hub 21 comprises an annular groove 25 in which may be engaged the branches of a clutch fork 27. Additionally, around the clutch hub 21 and under wheel 3 is assembled a clutch ring 29. Finally, a third wheel 31 (intermediate wheel) is mounted on shaft 5 and under ring 29.

The intermediate wheel 31 is driven by a fourth wheel, generally a seconds wheel (not shown on FIG. 1).

Finally, it will be noted that in standard fashion, the clutch hub 21 is surmounted by a spring 33 bearing against an abutment 35 driven onto shaft 5.

When the clutch hub 21 is disengaged, that is to say when fork 27 lifts it against the force of spring 33, the intermediate wheel 31, which is permanently in mesh with the seconds wheel (not shown), does not drive the clutch wheel 3. On the contrary, when clutch hub 21 is engaged (lower position), ring 29 is pressed into contact with the intermediate wheel 31 and consequently the clutch wheel 3 is driven in rotation, driving in turn the chronograph wheel 7. The latter thus constitutes the last wheel of a gear train. Consequently, it is understood that from the backlash phenomenon existing in particular between such chronograph wheel 7 and the clutch wheel 3, the chronograph hand 11 risks rotation in an irregular manner if one does not observe special precautions.

The brake arrangement 1 is used precisely to prevent this.

As may be seen on FIG. 1, the braking arrangement according to the invention comprises element 1 forming a brake arranged coaxially to the toothed clutch wheel 3 in a manner to be driven in rotation by the latter. To this end, the brake forming element 1 is provided with a circular central opening 37 (see also FIG. 3) and is maintained around the clutch hub 21 under the clutch wheel 3.

Figure 2:
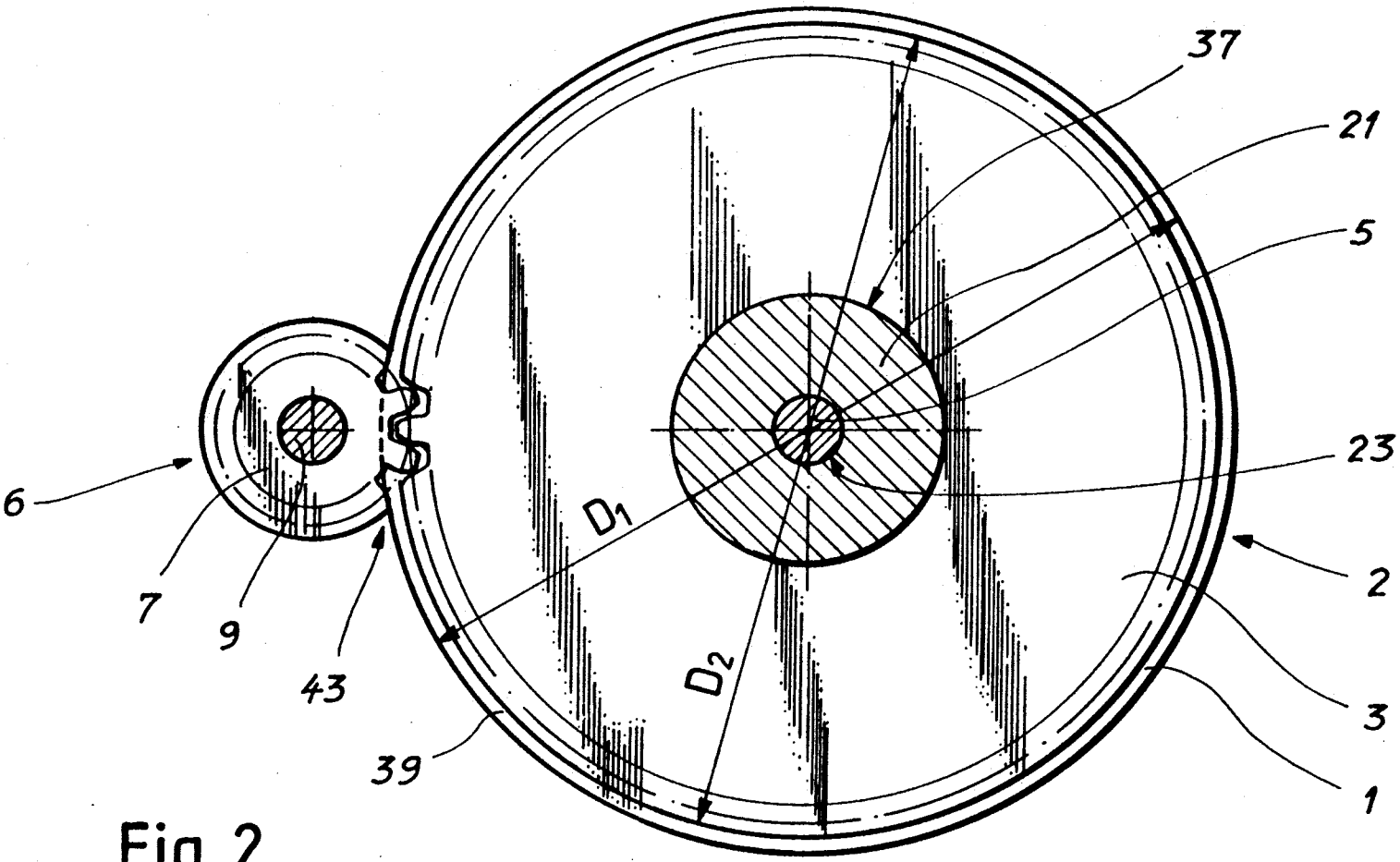
FIG. 2 shows a partial view taken along line II—II of FIG. 1.

When it is in the released state, the brake forming element assumes the form of a washer arched along one of its diametral axes, but when it is in place (see FIG. 1), it exhibits the form of a slightly deformed disc, the diameter $D_1$ of which is equal to or greater than the total diameter $D_2$ (diameter of the circumference at the top of the teeth) of the clutch wheel 3 in a manner to define at the periphery of such element 1 an annular friction surface 39 (see FIG. 2). On this figure, the brake forming element 1 extends beyond the periphery of wheel 3 in order better to obtain the annular friction surface 39. However, such element 1 could be of the same diameter as wheel 3.

The periphery of the brake forming element bears against wheel 3, the face of which is thus practically in contact with the entire surface of washer 1. The friction surface 39 is in contact with a portion of the periphery of the lower face of the chronograph wheel 7 and brakes the latter by rubbing. One is thus asssured that wheel 7 always effects equal angular steps in the course of the chronograph operation.

It will also be noted that, if preferably the friction surface 39 is continuous in order to assure regular rubbing, it could possibly be discontinuous.

Figure 3:
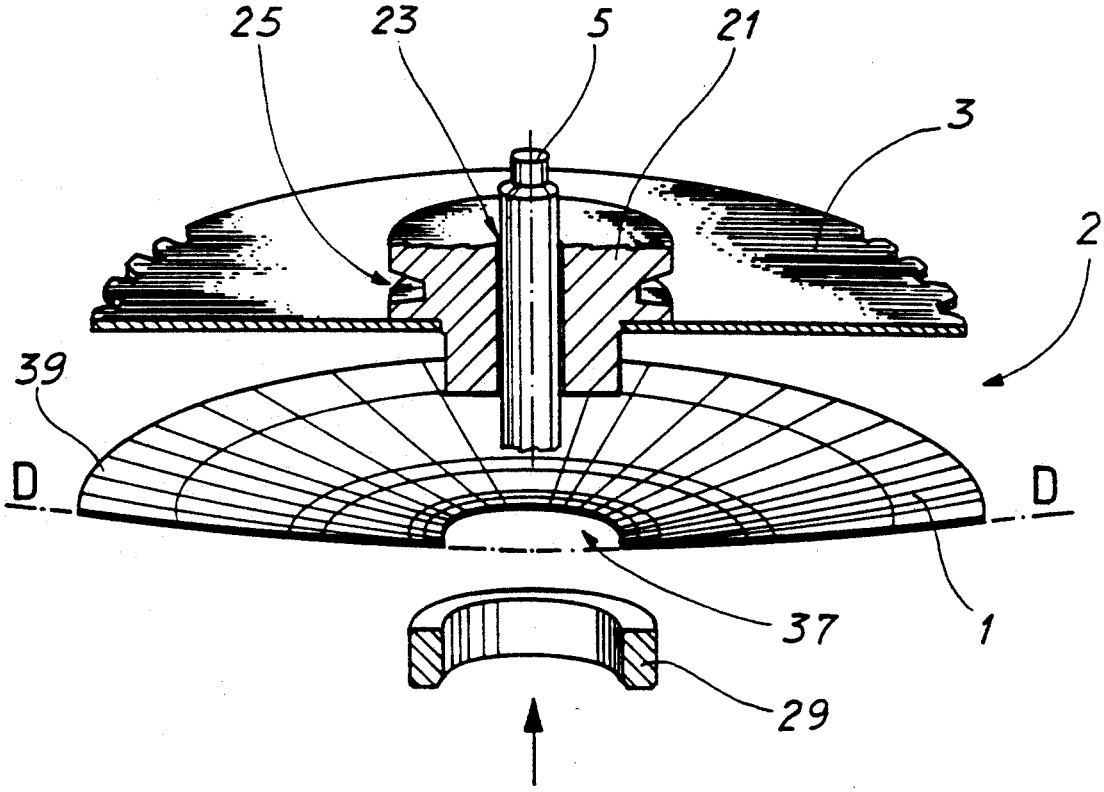
FIG. 3 shows an exploded perspective view and in cross-section of the braking arrangement prior to its assembly on the gear wheel, the brake forming element being cut in the axis along which it is arched.

FIG. 3 illustrates the different parts prior to their assembly in the construction shown on FIGS. 1 and 2.

On FIG. 3 one notes that, according to a preferred embodiment of the invention, the brake forming element 1 has, in its released state, the form of a washer arched along one of the diametral axes, here axis D—D. Such washer is formed of an elastic material, preferably brass, for reasons of manufacturing costs, but could also be formed in another elastic material. Its concave side is turned towards the clutch wheel 3. On the other hand, when it is in place, such washer is placed under stress between ring 29 and wheel 3, bearing by its peripheral friction surface 39 onto the surface of wheel 7. Thus, one obtains regular rubbing and hence good braking of the chronograph wheel 7.

Figure 4:
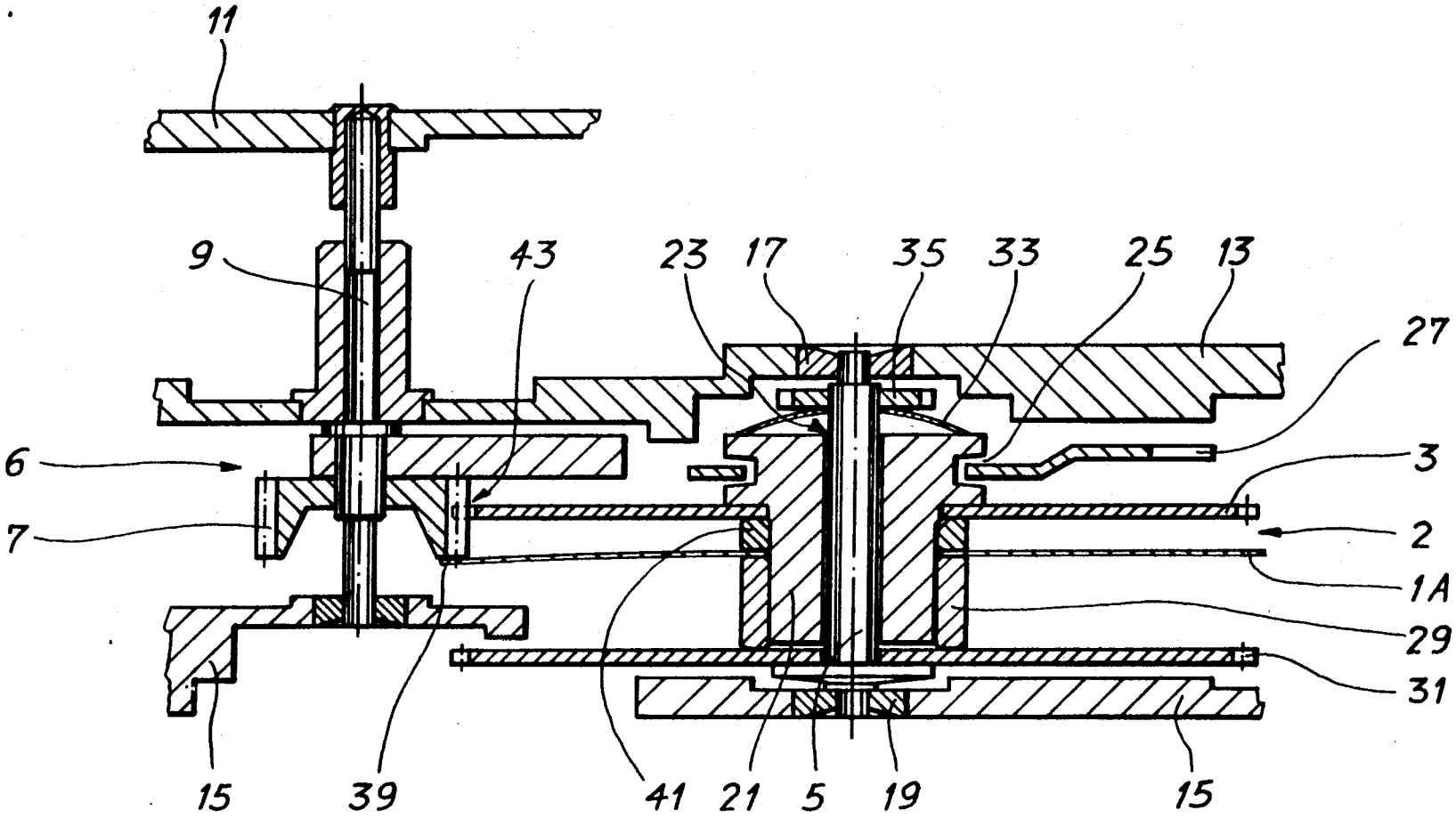
FIG. 4 shows another embodiment of the braking arrangement according to the invention, the brake forming element being assembled in a different manner from that shown by FIGS. 1 to 3.

FIG. 4 shows another embodiment of the invention. While on the preceding figures, the brake forming element is formed from an elastic washer, the concave side of which is turned towards wheel 3 and which is maintained applied against such wheel, the brake forming element of FIG. 4 is a disc 1A which is freely assembled around a clutch hub 21 while being fixed in rotation to the latter. Such disc is thus no longer flattened against wheel 3.

This arrangement enables more easily compensating the difference in level of the radial planes which the faces of the wheels in mesh may exhibit. Thus, as shown on FIG. 4, an adjustment ring 41 forming a spacer is mounted between the clutch wheel 3 and disc 1A. The thickness of such ring is chosen as a function of the difference in level between the faces of wheels 3 and 7. In other words, one chooses the axial position of the brake forming element 1 as a function of the axial position of the second wheel 7 in a manner such that in the meshing zone 43 of wheels 3 and 7, the corresponding portion of the friction surface 39 bears elastically against one of the faces of the second wheel 7.

In the two embodiments which have just been described (FIGS. 1 to 3 and 4 respectively) the braking arrangement is described in its application to a chronograph mechanism in which ring 29 at the same time plays the role of a clutch ring and that of means maintaining the brake forming element in place.

As is well understood, the invention is not limited to this special application. On the contrary, it may be advantageously employed in all cases in which in a gear train (of a simple watch for example), it is desirable to apply a braking force to one of the wheels in order to compensate for gearing backlash. In such case the brake forming element will be simply assembled around the shaft of one of the wheels, while being maintained against the latter by a simple fastening ring.

Figure 5:
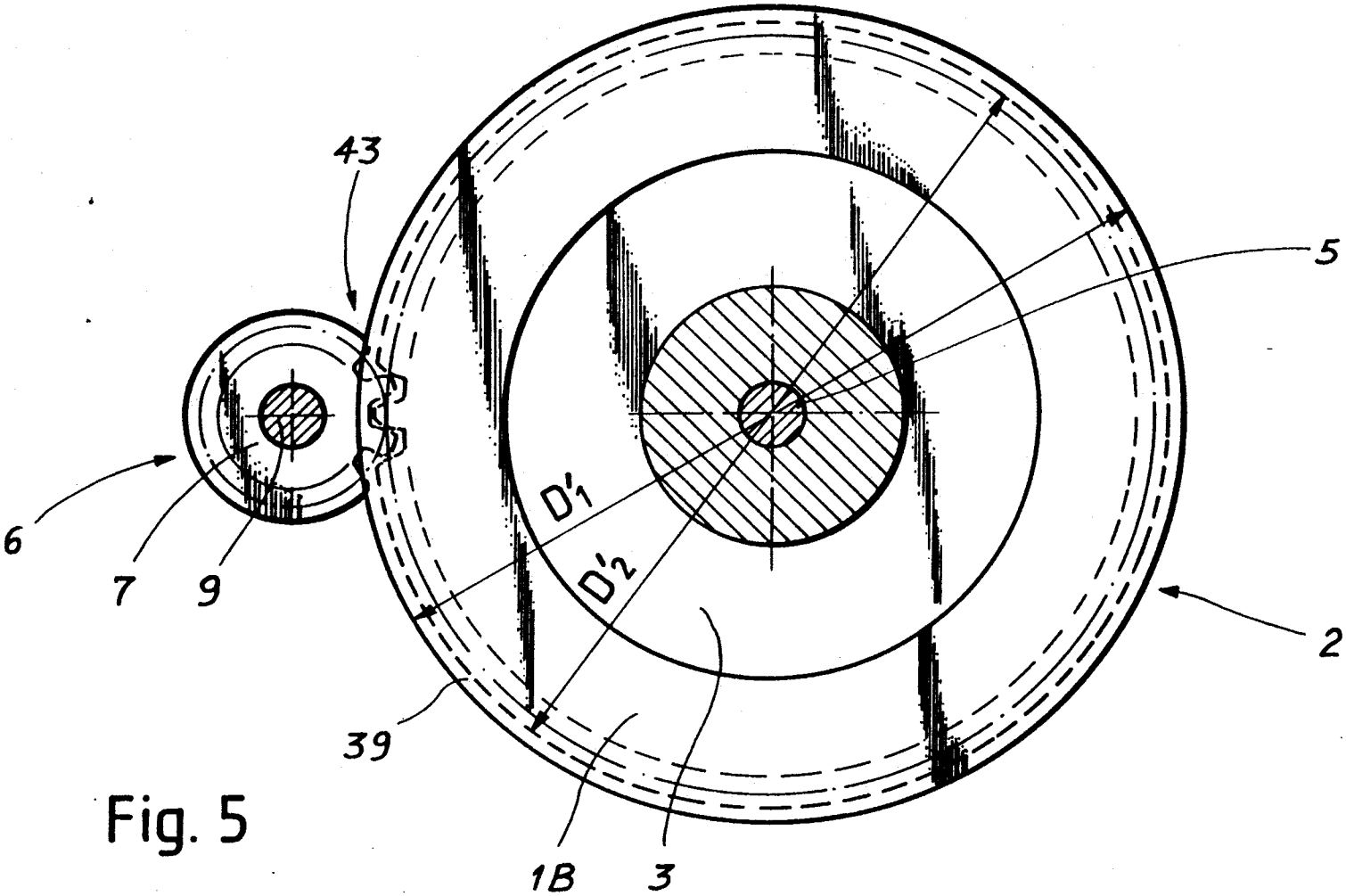
FIG. 5 is a schematic view of a variant embodiment of the invention taken in a direction opposite to that of FIG. 2.

FIG. 5 shows still another embodiment of the invention in which the braking arrangement includes a brake forming element 1B formed from a ring fixed onto one of the faces of the first wheel 3 by appropriate means such as gluing for instance. Such ring 1B is coaxial to wheel 3 and shows at its periphery a friction surface 39. There again there will be noted that the outer diameter $D'_1$ of such ring 1B is at least equal to the diameter $D'_2$ of wheel 3 onto which it is secured.

Such an embodiment will be preferably employed in clocks for instance showing gear wheels of a diameter greater than that of wheels generally employed in a watch.

What I claim is:

1. In a braking arrangement for a gear wheel in a gear train comprising at least first and second wheel sets, said first wheel set comprising a first shaft having an axis and a toothed wheel pivoting around said first shaft and meshing with said second wheel set, said second wheel set comprising a second shaft having an axis parallel to the first shaft and a second toothed wheel having a face and pivoting around said second shaft, the improvement comprising an elastic element forming a brake mounted coaxial to said first shaft, such brake forming element being associated with said first wheel set in a manner to be driven in rotation thereby, said elastic element having proximate its periphery a friction surface, the axial position of said brake forming element relative to said first shaft being chosen relative to the axial position of the second toothed wheel in a manner such that said friction surface bears elastically against said face of said second toothed wheel so as to brake said second toothed wheel.

2. A braking arrangement as set forth in claim 1 wherein the friction surface is continuous.

3. A braking arrangement as set forth in claim 1 or in claim 2 wherein the friction surface is annular.

4. A braking arrangement as set forth in claim 1 wherein said elastic element has an outer diameter, said outer diameter being greater than or equal to the total diameter of said first toothed wheel.

5. A braking arrangement as set forth in claim 1 wherein said elastic element in its released state has the form of a dish, the concave side of which said is positioned facing said first toothed wheel.

6. A braking arrangement as set forth in claim 1 wherein the brake forming element has the form of a disc.

7. A braking arrangement as set forth in claim 1 wherein the brake forming element has the form of a ring.

8. A braking arrangement as set forth in claim 5 wherein said elastic element is provided with a circular central opening and is assembled around said first shaft and further including a securing ring for maintaining said elastic element against said first toothed wheel.

9. A braking arrangement as set forth in claim 8 further including an adjustment ring forming a spacer mounted between said first toothed wheel and said elastic element.

10. A braking arrangement as set forth in claim 7 wherein the ring is fixed onto one of the faces of the first toothed wheel by gluing.

11. A braking arrangement as set forth in claim 1 wherein the brake forming element is fashioned in brass.

12. A braking arrangement as set forth in claim 6 wherein said elastic element is provided with a circular central opening and is assembled around said first shaft and further including a securing ring for maintaining said elastic element against said first toothed wheel.

13. A braking arrangement as set forth in claim 12 further including an adjustment ring forming a spacer mounted between said first toothed wheel and said elastic element.

14. A timepiece comprising first and second toothed wheels and a hand mounted to said second toothed wheel for rotation therewith, said first toothed wheel meshing with and driving said second toothed wheel, and a braking arrangement including an elastic element forming a brake mounted coaxially with said first toothed wheel for rotation therewith and said elastic element having a periphery and a friction surface proximate said periphery, said friction surface bearing elastically against one of the faces of said second toothed wheel so as to brake said second toothed wheel.

15. A timepiece as set forth in claim 14 wherein the first toothed wheel is a clutch wheel and said hand is a chronograph hand and further including a gear hub, said first toothed wheel being secured to said gear hub and a clutch ring mounted coaxially with said first toothed wheel, said elastic element being maintained around the gear hub between the clutch wheel and said clutch ring.

* * * * *